US006377221B1

(12) United States Patent
Lindenmeier et al.

(10) Patent No.: US 6,377,221 B1
(45) Date of Patent: Apr. 23, 2002

(54) WINDOW ANTENNA FOR A MOTOR VEHICLE

(75) Inventors: Heinz Lindenmeier, Planegg; Jochen Hopf, Haar; Leopold Reiter, Gilching, all of (DE)

(73) Assignee: FUBA Automotive GmbH & Co. KG, Bad Salzdetfurth (DE)

( * ) Notice: Subject to any disclaimer, the term of this patent is extended or adjusted under 35 U.S.C. 154(b) by 0 days.

(21) Appl. No.: 09/651,612

(22) Filed: Aug. 30, 2000

(30) Foreign Application Priority Data

Aug. 31, 1999 (DE) ..... 199 41 443

(51) Int. Cl.[7] ..... H01Q 1/32
(52) U.S. Cl. ..... 343/713; 343/712
(58) Field of Search ..... 343/711, 713, 343/704, 712, 725; H01Q 1/32, 13/10

(56) References Cited

U.S. PATENT DOCUMENTS 3,728,732 A * 4/1973 Igarashi ..... 343/713
4,791,426 A 12/1988 Lindenmeier et al. ..... 343/713
4,849,766 A * 7/1989 Inaba et al. ..... 343/713
5,138,330 A * 8/1992 Lindenmeier et al. ..... 343/713
5,883,599 A * 3/1999 Hall ..... 343/713
5,905,470 A * 5/1999 Fujii et al. ..... 343/713
5,926,141 A * 7/1999 Lindenmeier et al. ..... 343/713
6,121,934 A * 9/2000 Taniguchi et al. ..... 343/713

FOREIGN PATENT DOCUMENTS

DE 197 35 395 2/1998

* cited by examiner

*Primary Examiner*—Tho G. Phan
(74) *Attorney, Agent, or Firm*—Collard & Roe, P.C.

(57) ABSTRACT

The invention relates to an antenna on the window of a motor vehicle having a thin electrically conductive layer which is transparent for light, but reduces heat transmission. The window is formed by a window pane which can be lowered into the bottom part of a vehicle door, and can be moved by a window lifter. The pane is covered with an area having a limited conductivity formed by a layer of limited conductivity. An antenna connection point is formed between a horizontal sealing strip placed at the lower border of the window aperture and the window lifter in a free area which exists when the window is closed. The connection point is connected by high-frequency, low-loss means to the area of limited conductivity.

17 Claims, 6 Drawing Sheets

WINDOW ANTENNA FOR A MOTOR VEHICLE

BACKGROUND OF THE INVENTION

1. Field of the Invention

The invention relates to a window antenna for a motor vehicle having a thin electrically conductive layer which is transparent and reduces heat transmission.

2. The Prior Art

Antennas of this type are known from German Patent Application No. P 197 35 395. If disposed in the front windshield they suffer from interference due to digitally operating vehicle equipment. In the case of a front engine, interference results from the ignition system. For this reason, rear window antennas have been used in the past. The heating elements of the window heater were used containing a conductive layer which reduces heat transmission. To prevent the unfavorable impedance conditions due to the supply of heating current, the heating current for rear window antennas must always be supplied through an RF choke circuit. This choke circuit is particularly complex, especially for frequencies in the LMS region. For this reason, flat antenna conductors are used to receive LMS signals, which in many cases are offset from the heating surface, as are known from U.S. Pat. No. 4,791,426. In the case of a continuous conductive coating however, the antenna cannot be used without additional measures.

SUMMARY OF THE INVENTION

An object of the present invention is to provide an antenna having good reception characteristics both in the USW and TV region and in the LMS region while minimizing its complexity.

The antenna according to the invention provides special advantages compared with known antennas of the type which are based on heating areas with complex RF choke circuits in the region of long, medium, and short wave reception (LMS frequency region). By virtue of the long wavelength, the operating principle of an antenna according to the invention can be described by its capacitive effects, while the inductive effects can be disregarded.

DETAILED DESCRIPTION OF THE PREFERRED EMBODIMENT

Figure 2:
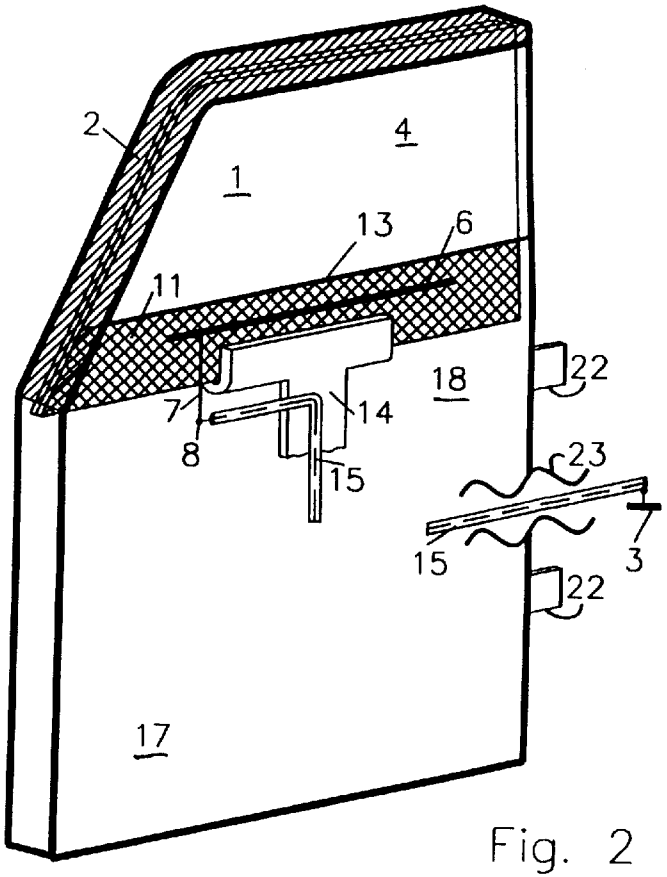
FIG. 2 shows an antenna according to the invention with an electrode-in the form of an elongated narrow strip or wire.
Figure 1:
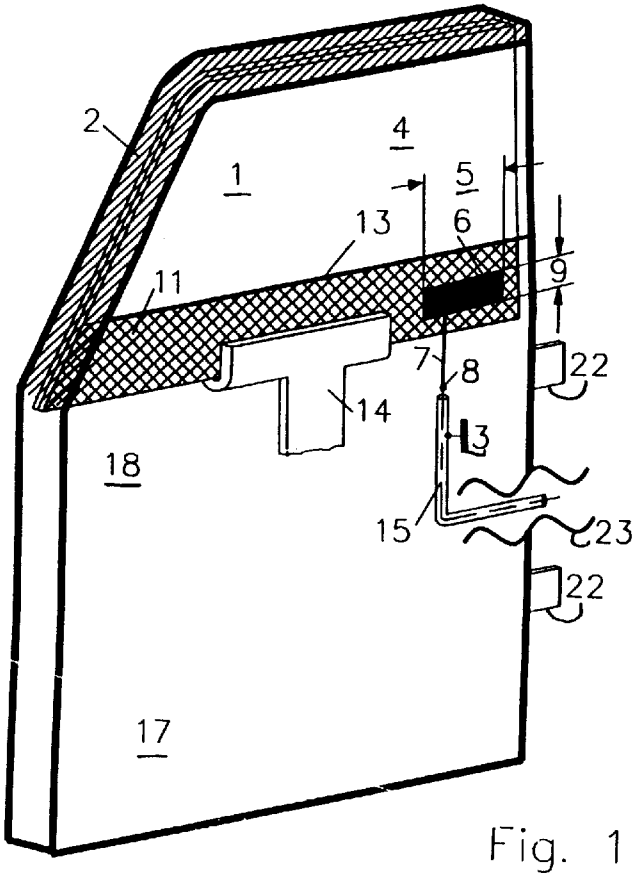
FIG. 1 shows an antenna according to the invention on the lowerable window of a vehicle door.

Referring to FIGS. 1–5, there is shown a vehicle door 17 with its window frame 2, which is shaded in the diagram. By means of a window lifter 14, window 1 can be lowered into bottom part 18 of vehicle door 17. The window covered with the conductive layer is electrically insulated all around, from window frame 2 and from window lifter 14. The normal position of the window is the closed condition (see FIG. 1). An antenna according to the invention has an electrode 6 on the lowerable window of a vehicle door 17, formed in a free area 11 of the window. Electrode 6 is connected via electrode lead 7 to an antenna lead 8 on the conductive layer. Antenna cable 15 is connected with its first lead to antenna lead 8, and with its second lead to a ground point 3 of the vehicle body. Antenna cable 15 is usually brought out of vehicle door 17 through a rubber grommet 23, and routed to receiver 25, which can be mounted in a region such as the dashboard. Vehicle door 17 is attached with hinges 22 to the vehicle body.

Figure 9:
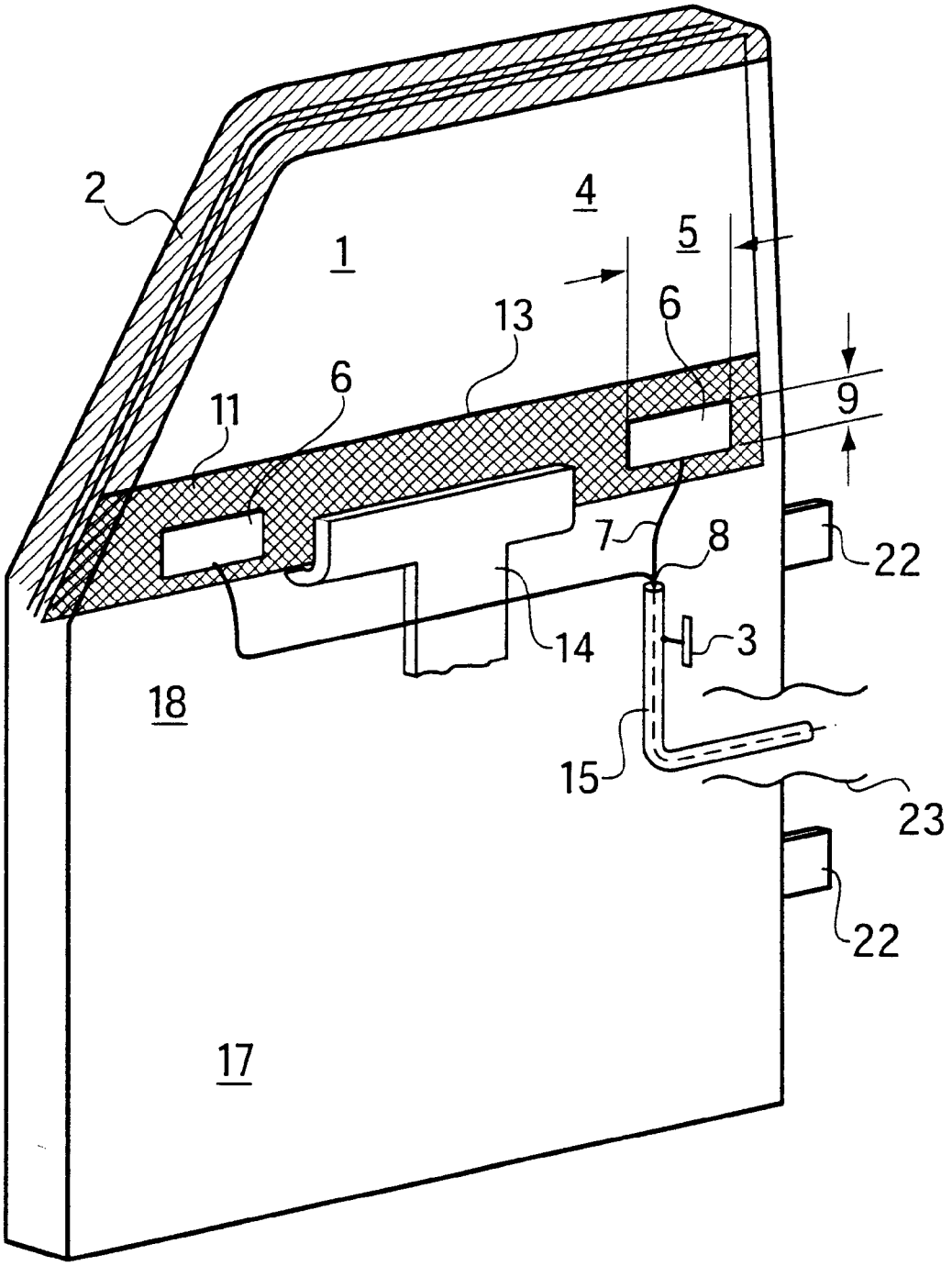
FIG. 9 shows a diversity antenna array according to an additional embodiment of the invention.

FIG. 9 shows a diversity antenna array according to an additional embodiment of the invention. In this embodiment, at least two electrodes 6 with a sufficiently large distance between one another are formed in the free area 11 to form a diversity type array of at least two antennas on the windowpane.

Figure 5:
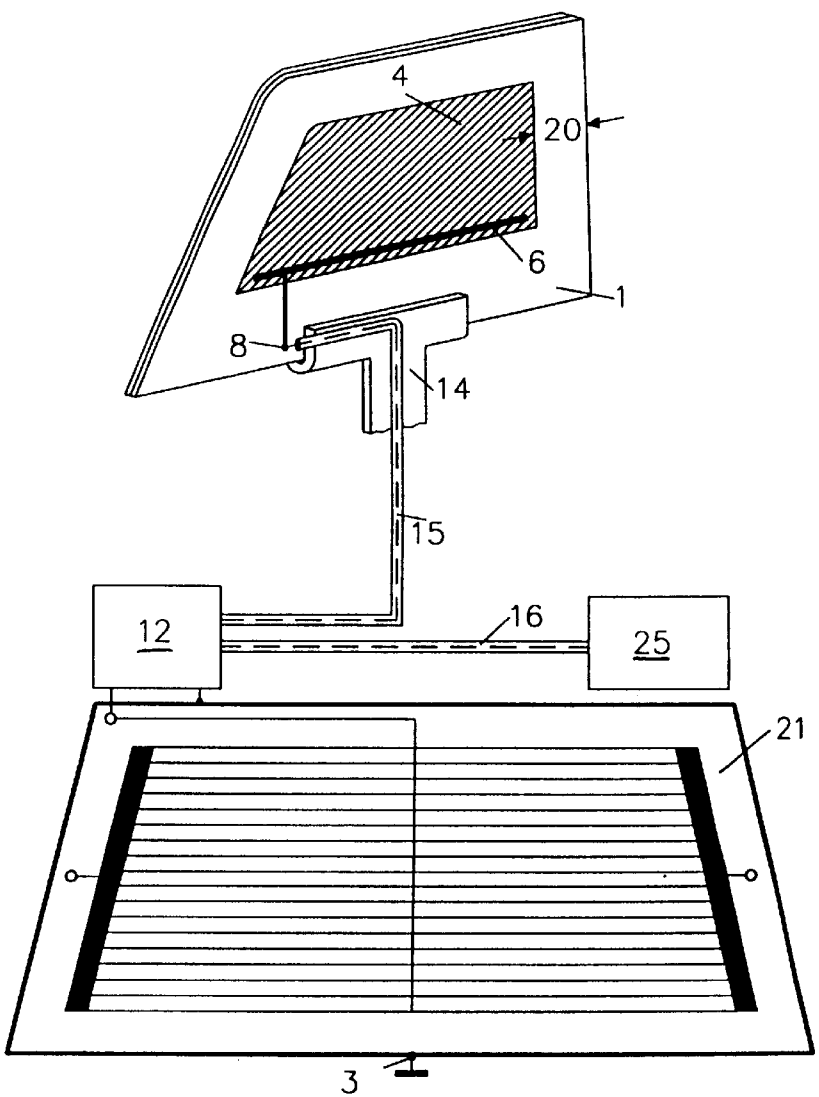
FIG. 5 shows an antenna according to the invention for the LMS frequency region as part of an antenna system with a USW antenna array having a USW/LMS antenna unit in the vicinity of a heated rear window pane of the motor vehicle.

By virtue of the layer which reduces heat transmission in combination with the air-conditioning system, the windows are opened very infrequently during driving. Reception is often very adequate even with the window three quarters open. By combining the signals of a plurality of window panes such as rear window 21 in the LMS region, or by using a plurality of inventive antennas in different door windows of a vehicle in a USW or TV diversity-type antenna system, the probability of reception loss is very small. Therefore, a very high-performance and inexpensive antenna system can be designed. Rear window 21 shown in FIG. 5 is a heated rear window pane that also serves as an antenna.

Figure 6A:
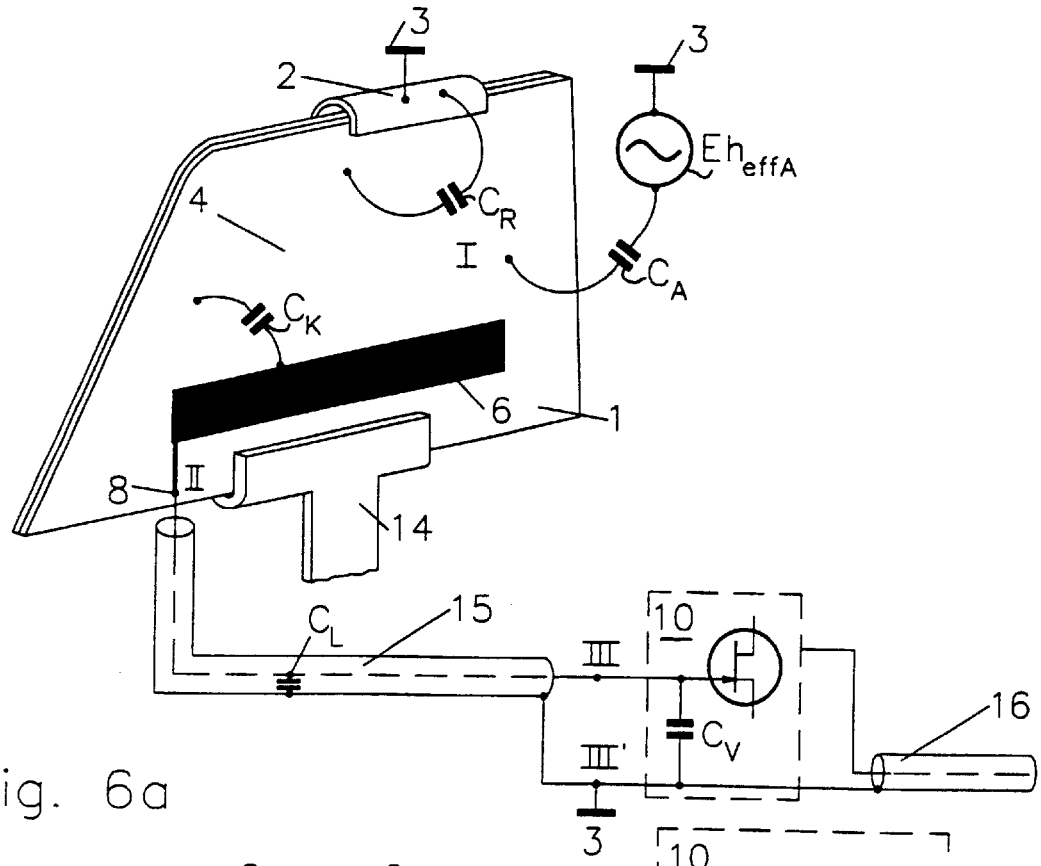
FIG. 6*a* shows a circuit having electrical active components of an antenna with an electrode capacitively coupled to an area of limited conductivity.

FIG. 6*a* schematically illustrates the no-load voltage $Eh_{eff\,A}$ across area 4 of limited conductivity at a received field strength E, the space capacitance $C_A$ of area 4 of limited conductivity, the capacitance $C_R$ between area 4 of limited conductivity and window frame 2 as well as the coupling capacitance $C_K$ between capacitive electrode 6 and area 4 of limited conductivity. The space capacitance $C_A$ is designated for the time being as the capacitance that can be measured at an area 4 of limited conductivity when the window is closed, assuming the coating of window pane 1 does not cover a window border which is sufficient in window frame 2. A customary value of $C_A$ is approximately 60 pF to 120 pF. The no-load voltage measured under these conditions per unit of received field strength E is the effective antenna height $h_{eff\,A}$ with typical values of between 3 and 4 cm. The capacitance $C_R$ for the coating of the border region is typically 100 to 250 pF depending on the construction of the window seal.

The received signals are conducted through antenna cable 15 to antenna amplifier 10 connected at its end. Amplifier 10 is contained, for example, in a USW antenna unit 12 as shown in FIG. 5. The capacitance of antenna cable 15 is denoted by $C_L$ and the active capacitance at the input of antenna amplifier 10 with $C_V$. Typical values for $C_V$ range between 5 and 20 pF and those for the cable capacitance range between 100 and 150 pF. The effective value of the noise voltage active at the "internal" amplifier element with an equivalent noise resistance $R_a$ is expressed for a bandwidth B by $u_r$, where:

$$u_r=\sqrt{4\cdot k\cdot T\cdot B\cdot R_a} \tag{1}$$

where k=Boltzmann constant, T=temperature in K.

For a simple and inexpensive embodiment of the invention, an electrode 6 having a form such as a conductive film, is adhesively bonded to one of the outer surfaces of the glass sandwich structure in order to create a capacitive connection between area 4 of limited conductivity and antenna connection point 8. In the process, electrode width 9 (FIG. 1) and electrode length 5 (meaning the electrode area) are given values sufficiently large to create an adequate coupling capacitance $C_K$. The electrical equivalent circuit diagram for determination of the signal-to-noise ratio S/N is illustrated in the reception situation in FIG. 6*b* and in FIG. 6*c* with the excitation $Eh_{eff\,IV}$ transformed at the point of action of the noise voltage. As a measure of the sensitivity, there can be used the limit field strength $E_g$ for S/N=1, and so:

$$E_g=u_r/h_{eff\,IV} \tag{2}$$

In the interests of adequate sensitivity, the internal effective height $h_{eff\,IV}$ should not be smaller than 1 cm at the available values of $R_a$ of modern low-noise amplifier elements. A standard rod antenna of 90 cm geometric length in the rear region of a car corresponds, for example, to an internal effective height $h_{eff}$ of about 3 to 4 cm, allowing for the cable capacitance at the amplifier input of a car radio. In the antenna, therefore, substantial importance is attached to transformation of the excitation $Eh_{eff\,A}$ achieved by area 4 of limited conductivity.

Figure 6B:
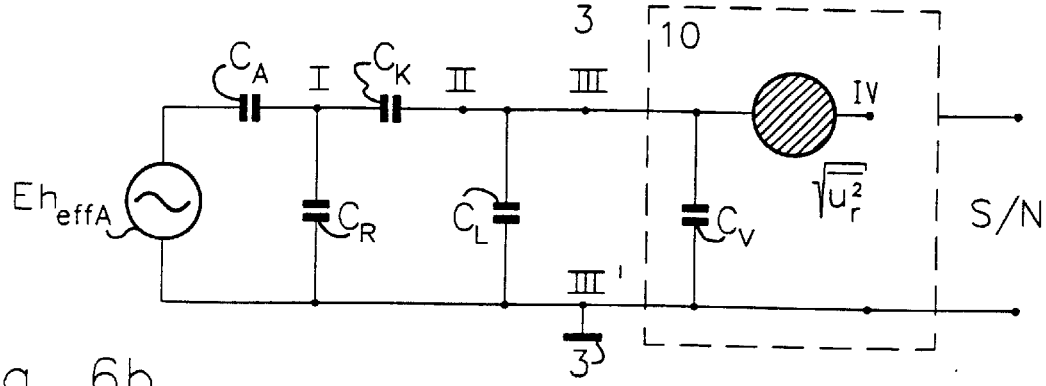
FIG. 6*b* shows an electrical equivalent circuit diagram with an internal noise source of antenna, an amplifier and capacitance which is effective for providing an improved signal-to-noise ratio.
Figure 6C:
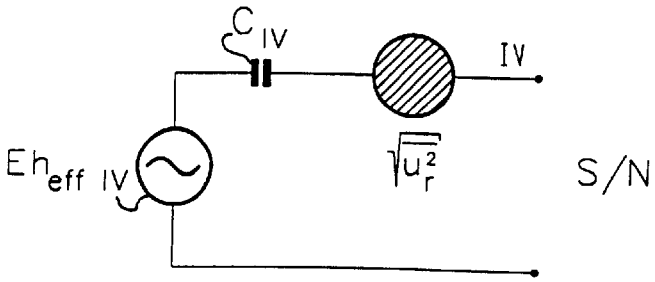
FIG. 6*c* shows a circuit having signal source transformed to the internal signal source which is effective at the location of the noise source of antenna amplifier, for determination of S/N in the form of the internal effective height.

From FIG. 6*b* there can be derived the following relationship for $h_{eff\,IV}$:

$$h_{eff\,IV}=\frac{h_{eff\,A}}{1+\frac{C_R+C_L}{C_A}+\left(1+\frac{C_R}{C_A}\right)\cdot\frac{C_L}{C_K}+\frac{C_V}{C_A}\cdot\left(1+\frac{C_A+C_R}{C_K}\right)} \tag{3}$$

By virtue of the capacitive load $C_L$ due to antenna cable 15, the coupling capacitance $C_K$ should have values on the order of several 100 pF for a few meters of cable length, in order that $h_{eff\,IV}$ will not have too small a value as a result of too high a value of $C_L/C_K$. This leads to a relatively large electrode area which, assuming a glass thickness of about 2 mm and a dielectric constant of 7, yields approximately $$A_E=0{,}32\ \text{cm}^2/\text{pF} \tag{4}$$

Figure 4:
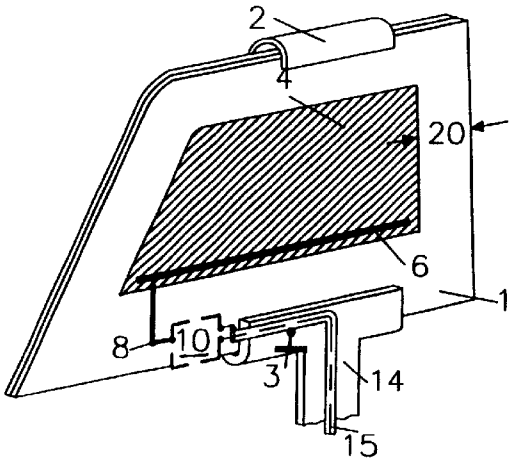
FIG. 4 shows an antenna according to the invention with an electrode coupled capacitively to an area of limited conductivity.

In an advantageous embodiment of the invention, it is therefore practical (see FIG. 7) to avoid the sensitivity-reducing effect of antenna cable 15 by connecting antenna amplifier 10 directly to capacitively coupled electrode 6. As also illustrated in FIG. 4, antenna amplifier 10 is then connected directly to electrode 6. Coupling capacitance $C_K$ should then be large only compared with the sum of the space capacitance $C_A$ and the capacitance $C_R$ of area 4 of limited conductivity relative to window frame 2. As regards the sensitivity of the antenna, an internal effective length $h_{eff\,IV}$ is given by:

$$h_{eff\,IV}=\frac{h_{eff\,A}}{1+\frac{C_R}{C_A}+\frac{C_V}{C_A}\cdot\left(1+\frac{C_A+C_R}{C_K}\right)} \tag{5}$$

Figure 7A:
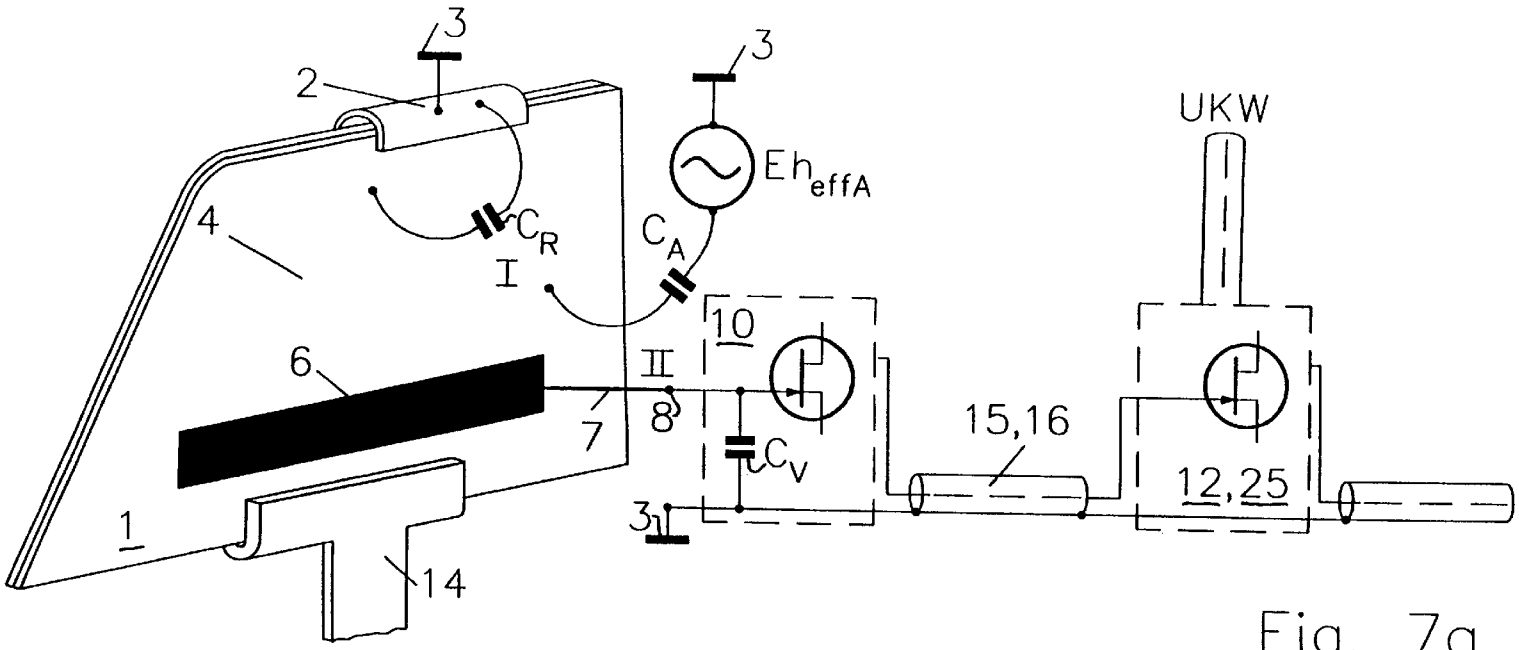
FIG. 7*a* shows an antenna as in FIG. 6*a*, having an electrode grounded to a layer of limited conductivity, and an antenna amplifier connected directly to the antenna connection point.
Figure 7B:
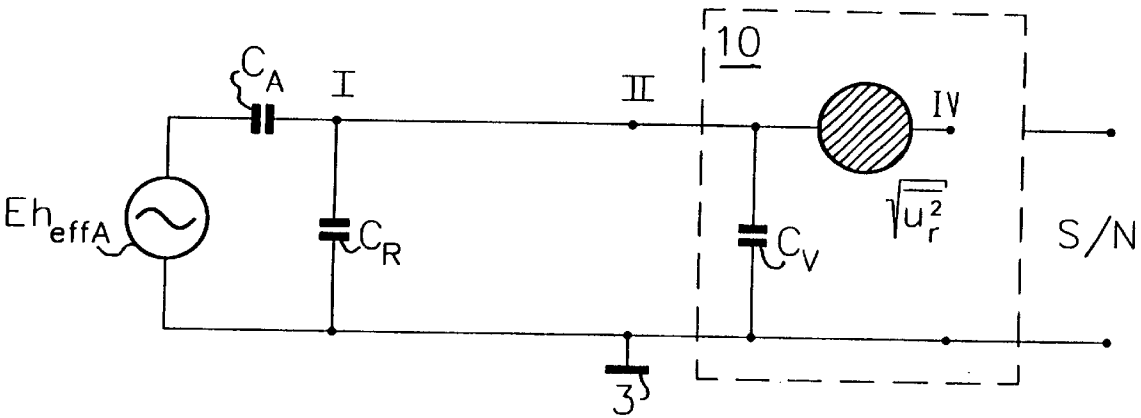
FIG. 7*b* shows an equivalent electrical circuit diagram, analogous to the circuit of FIG. 6*b*.

If capacitively coupled electrode 6 is replaced by an electrode 6 coupled galvanically to area 4 of limited conductivity, this can be accomplished by laying a narrow strip-like or wire-like electrical conductor in the glass sandwich structure of the laminated glass pane so that electrode 6 is in contact with the conductive layer over a sufficient electrode length 5. This is advantageous, in particular when free area 11 (of FIG. 1) provided for attachment of an electrode is very narrow, especially in its vertical extent. If antenna amplifier 10 is connected directly to electrode 6, as illustrated in FIG. 4 and FIG. 7*a*, the following relationship is obtained instead of equation (5) for the internal effective height $h_{eff\,IV}$:

$$h_{eff\,IV}=\frac{h_{eff\,A}}{1+\frac{C_R}{C_A}+\frac{C_V}{C_A}} \tag{6}$$

Figure 3:
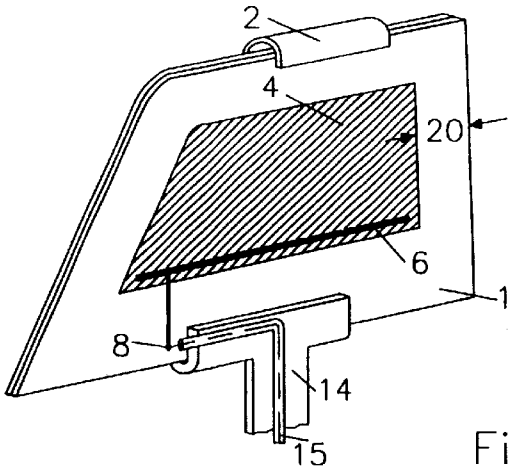
FIG. 3 shows an antenna according to the invention with reduced capacitance between an area of limited conductivity and the metal window frame.

However, in practice, it may often be less complex for antenna amplifier 10 to be connected to the end of antenna cable 15, as in FIG. 6*a*, and not to the movable window. In this case, considering the sensitivity of the receiving antenna, the absence of coupling capacitance $C_K$ is particularly favorable. In order to minimize the influence of the contact resistance between electrode 6 and area 4 of limited conductivity, it may be preferable to choose an electrode length 5 corresponding substantially to the entire length extent of the window, as illustrated in FIG. 3. This is particularly important where antenna amplifier 10 is connected at the end of antenna cable 15, since electrode 6 is additionally loaded by the capacitance $C_V$ of antenna amplifier 10. The operating principle of such an antenna according to the invention with galvanic coupling of electrode 6 to area 4 of limited conductivity has the following internal effective height $h_{eff\,IV}$:

$$h_{eff\,IV}=\frac{h_{eff\,A}}{1+\frac{C_R+C_L+C_V}{C_A}} \tag{7}$$

Figure 8A:
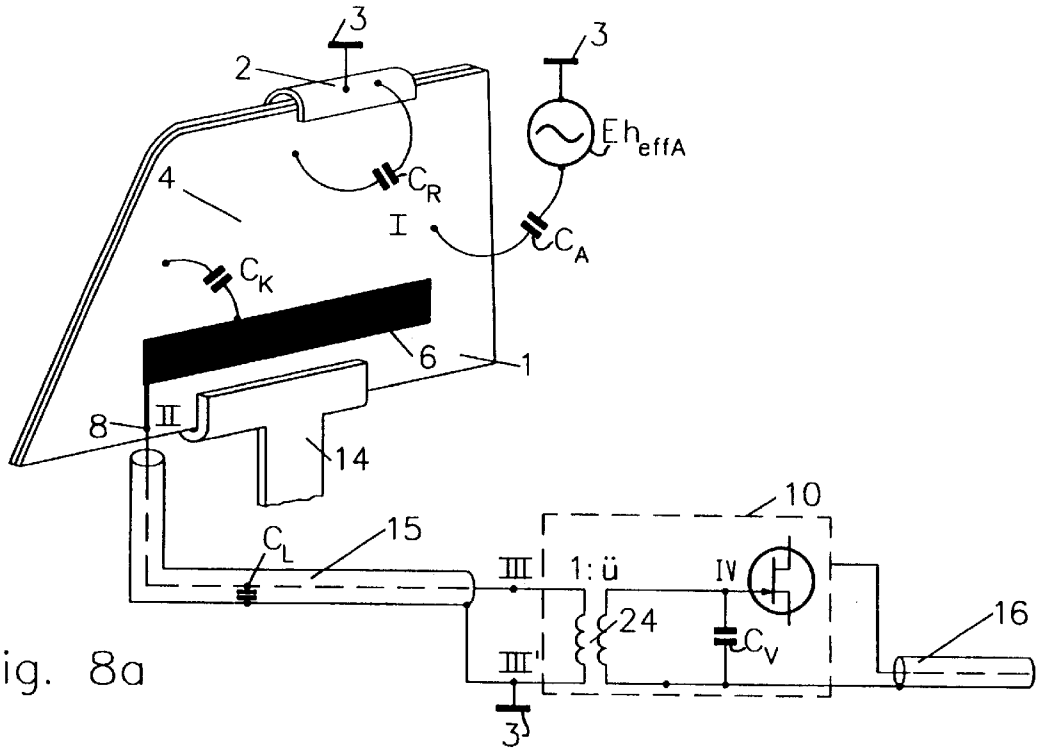
FIG. 8*a* shows an antenna as in FIG. 6*a*, but with an RF transformer with the smallest possible winding capacitance and an optimal step-up ratio disposed at the input of the antenna amplifier.

In a-advantageous embodiment, antenna amplifier 10 is, as illustrated in FIG. 8*a*, connected inexpensively to the end of antenna cable 15, and there is provided at the input of antenna amplifier 10 a low-capacitance transformer 24 with optimal step-up ratio $\ddot{u}_{opt}$ in order to reduce the sensitivity-reducing effect of load capacitances $C_R$ and $C_L$.

Figure 8B:
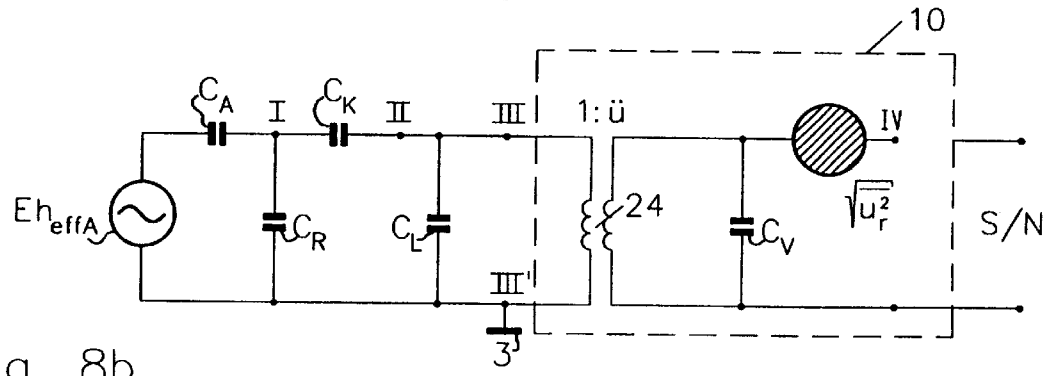
FIG. 8*b* shows an equivalent electrical circuit diagram analogous to the circuit of FIG. 6*b*.

The source which at the end of antenna cable 15 (see FIG. 8) energizes antenna amplifier 10 has, in the case of a capacitively coupled electrode 6, a capacitance $C_{III}$, where $$C_{III} = C_L + \frac{C_A + C_R}{1 + \frac{C_A + C_R}{C_K}} \tag{8}$$

The EMF active at the input terminals III—III' of antenna amplifier 10 is expressed by the height $h_{eff\ III}$ as follows:

$$h_{eff\ III} = \frac{h_{eff\ A}}{1 + \frac{C_R + C_L}{C_A} + \left(1 + \frac{C_R}{C_A}\right) \cdot \frac{C_L}{C_K}} \tag{9}$$

If the winding capacitance of transformer 24 which is active on the secondary side is given by $C_T$ and the capacitance of the antenna amplifier which is representative of the signal-to-noise ratio is given by $C_V$, then the internal effective height $h_{eff\ IV}$ relative to the signal-to-noise ratio at the amplifier output can be described as follows:

$$\begin{aligned} h_{eff\ IV} &= \frac{h_{eff\ III} \cdot \ddot{u}_{opt}}{2} \\ &= \frac{h_{eff\ A}}{2} \cdot \sqrt{\frac{C_A}{C_V + C_T}} \cdot \\ &\quad \frac{1}{\sqrt{1 + \frac{C_R}{C_A} + \frac{C_L}{C_A} \cdot \left(1 + \frac{C_A + C_R}{C_K}\right)}} \cdot \frac{1}{\sqrt{1 + \frac{C_A + C_R}{C_K}}} \end{aligned} \tag{10}$$

where $$\ddot{u}_{opt} = \sqrt{\frac{C_{III}}{C_V + C_T}} \tag{11}$$

Equation (10) provides that, in the case of inadequate coupling capacitance $C_K$, or in other words when the coupling capacitance $C_K$ cannot be made noticeably larger than $C_A+C_R$, especially at large cable capacitance $C_L$, galvanic coupling of electrode 6 to area 4 of limited conductivity is preferable to provide the largest possible internal effective height $h_{eff\ IV}$. Instead of equations (8), (9) and (10), the following relationships for $C_{III}$, $h_{eff\ III}$ and $h_{eff\ IV}$ are obtained for the galvanic coupling:

$$C_{III} = C_L + C_A + C_R \tag{12}$$

$$h_{eff\ III} = \frac{h_{eff\ A}}{1 + \frac{C_R + C_L}{C_A}} \tag{13}$$

$$\begin{aligned} h_{eff\ IV} &= \frac{h_{eff\ III} \cdot \ddot{u}_{opt}}{2} \\ &= \frac{h_{eff\ A}}{2} \cdot \sqrt{\frac{C_A}{C_V + C_T}} + \frac{1}{\sqrt{1 + \frac{C_R}{C_A} + \frac{C_L}{C_A}}} \end{aligned} \tag{14}$$

The optimal step-up ratio $\ddot{u}_{opt}$ of the transformer, even for the galvanic type of coupling, is in this case given by:

$$\ddot{u}_{opt} = \sqrt{\frac{C_{III}}{C_V + C_T}} \tag{15}$$

Special importance is attached to the effect of capacitance $C_R$ between window frame 2 and area 4 of limited conductivity. Both in capacitive and galvanic coupling, capacitance $C_R$ acts to reduce the internal effective height $h_{eff\ IV}$ of the antenna. It is therefore advantageous to make this capacitance as small as possible. If a border clearance 20 is provided between area 4 of limited conductivity and window frame 2 (FIGS. 3–5), then $h_{eff\ A}$ becomes larger in all of the above equations in question, whereas $C_A$ becomes smaller, and so at values of several centimeters, there are obtained larger values of $h_{eff\ IV}$ than in the case of the initially mentioned definition of a small border clearance 20 from window frame 2.

For stylistic reasons, the introduction of a border clearance 20 is somewhat more complicated in terms of vehicle engineering, since in practice, different tints are applied in border region 20 of window pane 1 and in the adjoining region of area 4 of limited conductivity. These color differences can be avoided, however, by providing the glass in border region 20 with an electrically neutral tint which corresponds to the color of area 4 of limited conductivity, or by interposing in the border region 20 of the glass sandwich structure, a plastic film which is electrically neutral but which also simulates the tint of area 4 of limited conductivity.

If the no-load voltage measured with adequate border clearance 20 (≧0.5 cm) from window frame 2 to area 4 of limited conductivity is represented by $Eh_{eff\ A}$, the effect of the border is included in this measurement, and the border capacitance can be inserted as $C_R$=0. If in addition, antenna amplifier 10 is then connected directly to antenna lead 8, meaning that $C_L \rightarrow 0$, albeit by means of high-frequency transformer 24 such that the step-up ratio is still $\ddot{u}_{opt}$, the internal effective height $h_{eff\ IV}$ from equation 14 becomes $$h_{eff\ IV} = \frac{h_{eff\ A}}{2} \cdot \sqrt{\frac{C_A}{C_V + C_T}} \tag{16}$$

and therefore usually exceeds the transformed internal effective height $h_{eff}$ of a rear rod antenna with a length of about 90 cm that would be calculated taking into consideration the cable capacitance $C_L$ at the receiver input.

The window pane (1) may preferably be constructed of two thinner glass panels joined together and having a transparent plastic film (4) disposed between them of limited conductivity.

Accordingly, while only a few embodiments of the present invention have been shown and described, it is obvious that many changes and modifications may be made thereunto without departing from the spirit and scope of the invention.

What is claimed is:

1. An antenna for mounting on a windowpane of a lowerable window of a motor vehicle having a window lifter for raising and lowering the window and a receiver coupled to the antenna, said antenna comprising:

(a) a thin, electrically low conductive layer transparent to light and capable of reducing the transmission of heat through the windowpane, said layer being disposed on the window and forming an area of limited conductivity on the windowpane;

(b) a horizontal sealing strip disposed on a lower border of the windowpane; and (c) an antenna connection point formed between said horizontal sealing strip and the window lifter, said antenna connection point high frequency coupled to said low conductive layer.

2. The antenna according to claim 1, further comprising:

(a) a ground point on the vehicle; and (b) at least one antenna cable having a first lead connected to said antenna connection point and a second lead connected to the ground point.

3. The antenna according to claim 2, wherein the ground point is disposed on the window lifter and is conductively connected to the vehicle.

4. The antenna according to claim 2, wherein the ground point is disposed at an end of said antenna cable.

5. The antenna according to claim 1, further comprising a border region formed in the periphery of the windowpane of the motor vehicle having a conductive window frame, said border region being disposed adjacent to and uncovered by said low conductive layer so as to reduce the capacitance between said low conductive layer and the window frame.

6. The antenna according to claim 1, wherein said antenna further comprises at least one substantially flat electrode made of highly conductive material high frequency coupled to said low conductive layer and to said antenna connection point, said at least one electrode disposed adjacent to at least one edge of said low conductive layer and being sufficiently long so as to minimize the loss created by said edge of said low conductive layer.

7. The antenna according to claim 6, wherein said at least one electrode is selected from the group consisting of an elongated narrow strip and a wire extending substantially parallel to said horizontal sealing strip and having galvanic contact to said area of limited conductivity, said at least one electrode being sufficiently long so as to minimize losses from said at least one electrode.

8. The antenna according to claim 6, wherein said antenna further comprises a dielectrically active layer made from plastic films, said dielectrically active layer having two surfaces, wherein said area of limited conductivity and said at least one electrode are applied on different surfaces of said dielectrically active layer, wherein the high frequency connection between said at least one electrode and said area of limited conductivity is made capacitively, and wherein the width of said at least one electrode is sufficiently long so as to create a capacitive connection of sufficiently low impedance.

9. The antenna according to claim 1 further comprising an antenna amplifier coupled to said antenna connection point, said antenna being designed as an LMS antenna having a high capacitive impedance.

10. The antenna according to claim 1, wherein said antenna comprises a free area disposed along the bottom edge of the windowpane, adjacent to the window lifter.

11. The antenna according to claim 10, further comprising at least two electrodes separated from each other and distributed within the free area to form a diversity antenna array on the windowpane.

12. The antenna according to claim 1, wherein said windowpane has at least two glass panels and said low conductive layer is laminated on an inner surface of one of the at least two panels of the windowpane.

13. The antenna according to claim 1, wherein the windowpane has at least two glass panels and said low conductive layer is laminated on a transparent plastic film embedded between the at least two panels of the windowpane.

14. An USW/LMS antenna unit comprising:

(a) at least one LMS antenna for mounting on a windowpane of a motor vehicle having a window lifter for raising and lowering the window and a receiver coupled to the antenna, said LMS antenna comprising (i) a thin, electrically low conductive layer transparent to light and capable of reducing the transmission of heat through the windowpane, said layer being disposed on the window and forming an area of limited conductivity on the windowpane;

(ii) a horizontal sealing strip disposed on a lower border of the windowpane; and (iii) an antenna connection point formed between said horizontal sealing strip and the window lifter, said antenna connection point high frequency coupled to said low conductive layer; and (b) a USW antenna array having a USW antenna unit for mounting in the vicinity of a heated rear windowpane of the vehicle and an antenna cable connected to said USW antenna unit, wherein the received LMS signals are combined in said USW antenna unit.

15. The USW/LMS antenna unit according to claim 14, wherein said at least one LMS antenna comprises at least two LMS door antennas mounted in at least two different doors of the same motor vehicle, each door antenna being coupled to said USW antenna unit and further comprising a summation circuit coupled to said at least two door antennas for combining the LMS signals to obtain one LMS signal.

16. An antenna for mounting on a windowpane of a lowerable window of a motor vehicle having a window lifter for raising and lowering the window, a receiver coupled to the antenna and a ground point, said antenna comprising:

(a) a thin, electrically low conductive layer transparent to light and capable of reducing the transmission of heat through the windowpane, said layer being disposed on the window and forming an area of limited conductivity on the windowpane;

(b) a horizontal sealing strip disposed on a lower border of the windowpane;

(c) an antenna connection point formed between said horizontal sealing strip and the window lifter, said antenna connection point high frequency coupled to said low conductive layer; and (d) at least one antenna cable having a first lead connected to said antenna connection point and a second lead connected to the ground point;

wherein said antenna comprises a first broad-band antenna for the LMS/USW and TV frequency bands disposed on the window of one of the vehicle doors, and at least one other antenna for the USW and TV frequency bands on at least one other window of another vehicle door, said at least one antenna cable being coupled to a diversity antenna device installed in the vehicle.

17. A lowerable window assembly for a motor vehicle having a receiver comprising (a) a lowerable window;

(b) a window lifter coupled to said window for raising and lowering said window; and (c) an antenna mounted on a windowpane of said lowerable window and coupled to the receiver, said antenna comprising:

(i) a thin, electrically low conductive layer transparent to light and capable of reducing the transmission of heat through the windowpane, said layer being disposed on the window and forming an area of limited conductivity on the windowpane;

(ii) a horizontal sealing strip disposed on a lower border of the windowpane; and (iii) an antenna connection point formed between said horizontal sealing strip and said window lifter, said antenna connection point high frequency coupled to said low conductive layer.

* * * * *